United States Patent [19]

Mininni et al.

[11] 4,415,521

[45] Nov. 15, 1983

[54] PROCESS FOR ACHIEVING HIGHER ORIENTATION IN PARTIALLY ORIENTED YARNS

[75] Inventors: Robert M. Mininni, Maplewood; Sunil K. Garg, Westfield; Henry H. George, Jr., Berkeley Heights; Anne Holt, Westfield; Steven B. Warner, Bernardsville, all of N.J.

[73] Assignee: Celanese Corporation, New York, N.Y.

[21] Appl. No.: 357,951

[22] Filed: Mar. 15, 1982

[51] Int. Cl.[3] ..... D01D 1/04

[52] U.S. Cl. ..... 264/176 F; 264/237; 425/72 S

[58] Field of Search ..... 264/176 F, 237; 425/72 S

[56] References Cited

U.S. PATENT DOCUMENTS 4,195,161 3/1980 Davis et al. ..... 264/176 F
4,237,187 12/1980 Raybon et al. ..... 264/176 F

FOREIGN PATENT DOCUMENTS 34880 2/1981 European Pat. Off. ..... 264/210.8
2117659 10/1972 Fed. Rep. of Germany ... 264/210.8

*Primary Examiner*—Jay H. Woo
*Attorney, Agent, or Firm*—Burns, Doane, Swecker & Mathis

[57] ABSTRACT

Provided is a process for melt spinning a partially oriented yarn of increased birefringence, and hence higher orientation, for a given wind-up speed. The process comprises extruding a molten fiber forming polyester through a shaped orifice to form a molten filamentary material, which is then passed in the direction of its length into a quench zone wherein the filamentary material is contacted with a first gaseous quenching medium. While the filamentary material is still in a deformable state, however, it is passed through a hot zone provided with an atmosphere having a temperature greater than the first gaseous quenching medium and greater than the glass transition temperature of the molten polyester filamentary material. The filamentary material is then withdrawn from the hot zone and contacted with a second gaseous quenching medium at a temperature below the glass transition temperature of the filamentary material until the filamentary material is no longer deformable, after which the filamentary material is withdrawn from the quench zone.

23 Claims, 1 Drawing Figure

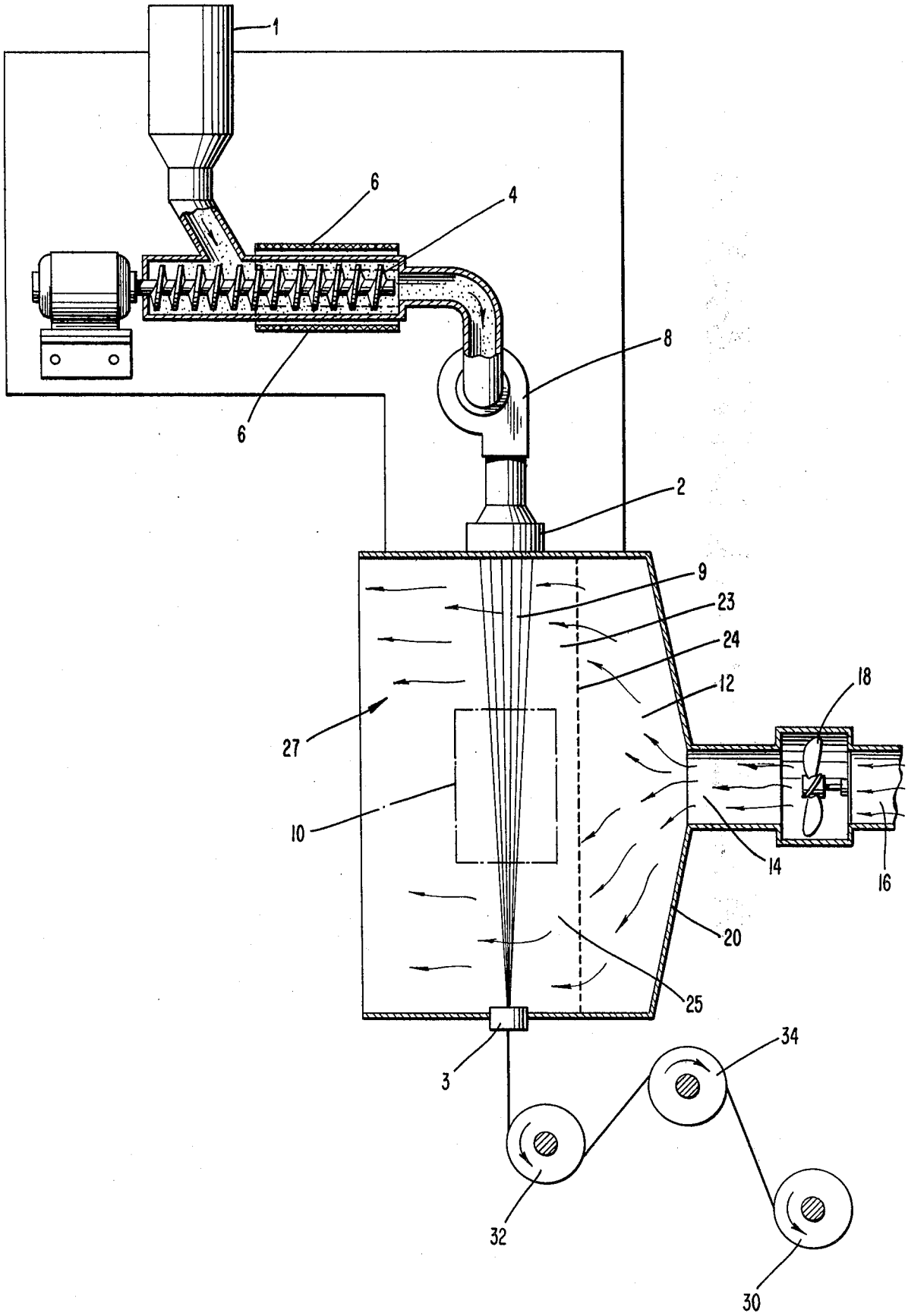
1
6
4
8
6
2
9
23
24
12
18
27
10
14
16
20
25
3
34
32
30

PROCESS FOR ACHIEVING HIGHER ORIENTATION IN PARTIALLY ORIENTED YARNS

BACKGROUND OF THE INVENTION

1. Field of the Invention

The present invention relates to the preparation of POY (partially oriented yarn) of increased birefringence and orientation at a given wind-up speed. More particularly, the present invention relates to the preparation of partially oriented polyester yarn of increased birefringence for a given wind-up speed by passing extruded polyester filamentary material through a hot zone subsequent to a quenching of the material but with the filamentary material still being in a deformable state.

2. Description of the Prior Art

In conventional filament spinning processes, for example, in the spinning of polyester yarn, the orientation of the spun filamentary material, as measured by birefringence, increases with increased wind-up speeds. Process parameters such as the spinning temperature and quench flow can be adjusted accordingly to increase the birefringence at a constant or given wind-up speed, however, the effects are generally minor and/or the process changes result in much poorer yarn uniformity.

The use of a hot tube or hot zone in spinning processes are known to achieve various effects. For example, melt spinning processes have been proposed wherein the cooling of the extruded filamentary material has been retarded, i.e., prolonged, prior to solidification so as to alter the properties thereof. See, for instance, U.S. Pat. No. 2,323,383; and 3,361,859. Such processes generally pertain to the use of a hot shroud immediately below the spinneret face so as to maintain the extruded filaments in a molten state for a predetermined period of time.

U.S. Pat. No. 3,053,611 pertains to a process for spinning fully stretched fibers by fully stretching the fibers upon leaving the spinning jet, whereby they are spun in a spinning shaft whose upper part is heated to 10°-80° C. below the melting point of the resin to be spun and whose lower part is heated to a temperature below 100° C.

U.S. Pat. No. 3,969,462 discloses a method for the production of an industrial polyester filament yarn wherein a plurality of filaments are melt-spun into a heated zone coupled with controlled cooling. In particular, the process disclosed produces yarn by melt spinning into a heated zone which maintains the filaments molten for an interval below the spinneret face with subsequent quenching of the filaments being achieved with a radial outflow of cooling gases, thereby producing a low birefringence yarn which is capable of being drawn at high draw ratios to high tenacities.

U.S. Pat. No. 3,946,100, of common assignee, discloses a process for producing polymeric filamentary material or film of improved tensile strength and modulus and diminished shrinkage characteristics, wherein a thermal conditioning zone is employed after solidification of the melt spun filamentary material, but prior to wind-up. In the process, molten meltspinnable polymeric material capable of undergoing crystallization, such as a polyester, is extruded through a shaped orifice to form a filamentary material or film, quenched to below its glass transition temperature to form a solid filamentary material or film, and then passed for a brief residence time through a thermal conditioning zone at a temperature between its glass transition temperature and its melting temperature wherein substantial crystallization of the previously solidified filamentary material takes place under high stress conditions. The filamentary material is then withdrawn from the thermal conditioning zone. Thereby, the birefringence and tensile properties of the filamentary material are increased and improved so much so that a conventional hot drawing step may be unnecessary. U.S. Pat. No. 4,195,161, also a common assignee, more fully describes the unique polyester fiber which is obtained thereby.

See also European Application No. 0,034,880 and the patents discussed therein regarding melt spinning processes employing a thermal conditioning zone provided with a gaseous atmosphere at a temperature above the glass transition temperature of the filamentary material but below its melting temperature, through which a solidified filamentary material is passed prior to wind-up.

It is an object of the present invention, however, to provide an expeditious and improved process for achieving partially oriented yarn products exhibiting POY like properties but exhibiting significantly higher orientation for a given or constant wind-up speed.

It is another object of the present invention to provide a process for achieving high wind-up speed orientation in a partially oriented yarn at lower wind-up speeds via the use of a hot zone.

It is still another object of the present invention to provide an expeditious process for preparing partially oriented polyester yarn which is subsequently to be drawn and/or textured.

These and other objects, as well as the scope, nature and utilization of the invention, will be apparent to those skilled in the art from the following description and appended claims.

SUMMARY OF THE INVENTION

It has been surprisingly found that an improved process for expeditously melt spinning a partially oriented yarn of increased birefringence, i.e., higher orientation, for a given wind-up speed comprises:

(i) extruding a molten fiber forming polyester through a shaped orifice to form a molten filamentary material, (ii) passing said molten filamentary material in the direction of its length into a quench zone, wherein the filamentary material is initially contacted with a first gaseous quenching medium at a temperature well below the melting temperature of the filamentary material, and wherein prior to solidification so that the filamentary material is still in a deformable state, i.e., less than two-tenths gram per denier tension can deform the filamentary material, the filamentary material is passed through a hot zone provided with an atmosphere having a temperature greater than the temperature of the first gaseous quenching medium and greater than the glass transition temperature of the molten polyester filamentary material, with the resulting filamentary material then being withdrawn from said hot zone and contacted with a second gaseous quenching medium at a temperature below the glass transition temperature of the filamentary material until the filamentary material is no longer deformable, and then (iii) withdrawing the filamentary material from the quench zone;

with the processing of the polyester filamentary material following the extrusion being conducted at a substantially constant take-up speed.

It is preferred that the two gaseous quenching media, which can be the same or different, both be at a temperature below the glass transition temperature of the filamentary material.

In one preferred embodiment of the present invention, the filamentary material is passed through a hot zone of a length not greater than about 2 feet, which is provided with an atmosphere having a temperature in the range of from about 150° to about 300° C., wherein the hot zone is positioned near the threadline freezepoint of the filamentary material (as determined in the absence of a hot zone), and with the withdrawal of the filamentary material from the quench zone being at a rate of from about 1000 to about 6000 meters per minute.

The term partially oriented yarn (POY) as used herein is meant to connote a yarn having only some orientation, i.e., having a birefringence of from about 0.005 to about 0.100, and, more preferably from 0.020 to 0.060, but which is not comparable with a drawn or fully oriented yarn.

BRIEF DESCRIPTION OF THE DRAWING

The drawing is a schematic presentation of an apparatus arrangement suitable for carrying out the process of the present invention.

DESCRIPTION OF THE PREFERRED EMBODIMENTS

The preferred polymeric materials for use in the present process are melt-spinnable polyesters. For instance, the melt-spinnable polyester selected for use in the present process may be principally polyethylene terephthalate, and preferably contains at least 75 mol percent polyethylene terephthalate, and most preferably at least 85 mol percent polyethylene terephthalate. In a particularly preferred embodiment of the process the melt-spinnable polyester is substantially all polyethylene terephthalate. Alternatively, during the preparation of the polyester minor amounts of one or more ester-forming ingredients other than ethylene glycol and terephthalic acid or its derivatives may be copolymerized. For instance, the melt-spinnable polyester may contain 75 to 100 mol percent (preferably 85 to 100 mol percent) polyethylene terephthalate structural units and 0 to 25 mol percent (preferably 0 to 15 mol percent) copolymerized esters units other than polyethylene terephthalate. Illustrative examples of other ester-forming ingredients which may be copolymerized with the polyethylene terephthalate units include glycols such as diethylene glycol, tetramethylene glycol, hexamethylene glycol, pentaerythitol, etc., and dicarboxylic acids such as hexahydroterephthalic acid, dibenzoic acid, adipic acid, sebacic acid, azelaic acid, etc.

The melt-spinnable polyethylene terephthalate selected for use in the process preferably exhibits an intrinsic viscosity, i.e., I.V., of about 0.45 to 1.0, and an I.V. of about 0.5 to 0.75 in a particularly preferred embodiment of the process. The I.V. of the melt-spinnable polyester may be conveniently determined by the equation $$IV = \lim_{c \to o} \left( \frac{\ln \eta r}{c} \right)$$

where $\eta r$ is the "relative viscosity" obtained by dividing the viscosity of a dilute solution of the polymer by the viscosity of the solvent employed (measured at the same temperature), and c is the polymer concentration in the solution expressed in grams/100 ml. The polyethylene terephthalate additionally commonly exhibits a glass transition temperature of about 60° to 80° C. and a melting point of about 250° to 265° C., e.g., about 260° C.

The polymer may also comprise conventional additives, such as, finely divided particulate fillers, e.g., $TiO_2$ and $SiO_2$, preferably in an amount ranging from 0 to about 10 weight percent, and most preferably in an amount ranging from 0 to about 1 weight percent based upon the total weight of polymer.

The extrusion orifice may be selected from among those commonly utilized during the melt extrusion of fibers. For instance, for forming a filamentary material the spinneret selected for use in the process may contain one or preferably a plurality of extrusion orifices. For example, a standard spinneret containing 1 to 200 holes (e.g., 6 to 200 holes), such as commonly used in the melt spinning of polyethylene terephthalate, having a diameter of about 5 to 60 mils (e.g., 10 to 20 mils) may be utilized in the process. In general, while the filamentary material may be a monofilament, yarns of about 10 to 72 continuous filaments are commonly formed. The melt-spinnable polymeric material is supplied to the extrusion orifice at a temperature above its melting point.

A molten polyester comprising principally polyethylene terephthalate is preferably at a temperature of about 250° to 310° C., and most preferably at a temperature of about 285° C. to 305° C. (e.g., 300° C.) when extruded through the spinneret.

Subsequent to extrusion through the spinneret, the molten filamentary material is passed in the direction of its length through a solidification or quench zone. In the quench zone, the filamentary material is initially contacted with a first aqueous quenching medium at a temperature well below the melting point of the polyester to thereby effect rapid cooling of the molten filamentary material. Suitable temperatures of the first gaseous quenching medium below the melting point of the polyester can range as high as about 60° C. greater than the glass transition temperature of the polyester material, with the temperature, however, preferably being below the glass transition temperature of the polyester. In a preferred embodiment of the process the gaseous quench medium is provided at a temperature of about 10° to 55° C., and most preferably at about room temperature, e.g., at about 30° C. The first quench medium can be forced through the quench zone so as to bring about more efficient heat transfer, or the quench medium can be unforced.

The chemical composition of the gaseous quenching medium is not critical to the operation of the process provided the gaseous medium is not unduly reactive with the polymeric filamentary material. It is particularly preferred that the gaseous quenching medium be air. Other representative gaseous quenching media which may be selected for utilization include inert gases such as helium, argon, nitrogen, etc.

The duration of the contacting of the filamentary material with the first gaseous quenching medium must be insufficient to result in solidification of the filamentary material as the filamentary material must still be in a deformable state when it passes through the hot zone. Thus, with the filamentary material still in a deformable state, i.e., requiring less than two-tenths gram per denier tension to deform same, the contact of the filamentary material with the first quenching medium is terminated and the filamentary material is passed through a hot zone provided with an atmosphere having a temperature greater than the first aqueous quenching medium and greater than the glass transition temperature of the filamentary material. It is most preferred that the contact with the first quenching medium be sufficient to result in a reduction in the temperature of the filamentary material of from about 80 to 160 degrees centigrade in temperature, and most preferably from about 120 to about 150 degrees centigrade, prior to being passed through the hot zone. Thereby the filamentary material approaches its glass transition temperature.

The position of the hot zone is preferably near the threadline freezepoint of the filamentary material, as determined in the absence of the hot zone under the same set of conditions of wind-up speed, quench temperature, etc. The threadline freezepoint of the filamentary material for the purposes of the present invention is that point wherein deformation essentially stops in the threadline in the quench zone, again with the freezepoint being determined in the absence of the hot zone under the otherwise same conditions. Various conventional instruments can be employed to readily determine the threadline freezepoint, and hence the preferred position of the hot zone. For example, high speed photography or a laser doppler anemometer can be successfully employed, with particularly good results being achievable through the use of a laser doppler anemometer.

In positioning the hot zone "near" the threadline freezepoint, the hot zone can be positioned so that its middle is above, at or below the threadline freezepoint. However, the top of the hot zone must always be at least at or above the threadline freezepoint. In this manner the filamentary material is insured of being in a deformable state when it enters the hot zone.

The temperature of the hot zone atmosphere is preferably in the range of from about 150° to 300° C., and is typically in the range of from about 200° to 280° C. The chemical composition of the gaseous atmosphere provided within the hot zone is not critical to the operation of the process provided the gaseous atmosphere is not unduly reactive with the polymeric filamentary material or film. Representative gaseous atmospheres which may be employed in the hot zone include air, helium, argon, nitrogen, steam, etc., with air being most preferred. Resistance heaters or any other heating means, e.g., infrared heaters and steam jackets, may be provided so as to maintain the hot zone at the required temperature.

The length of the hot zone is generally any length sufficient to provide a sufficient residence time in the hot zone under the predetermined conditions of wind-up speed, position of the hot zone and temperature so as to result in achieving and realizing the advantages of the present invention. An appropriate length has been found to be from about 12 inches to about 24 inches, with about 18 inches being a most practical length. Lengths of greater than 24 inches can be used, but they are necessarily less convenient as more room is needed to achieve the desired results. Thus, as a practical matter, it is preferred to employ a zone length of about 24 inches or less. Zones of less than 12 inches, however, generally result in insufficient residence time in conjunction with conventional wind-up speeds of from 1000 to 6000 meters per minute to realize the advantageous effects of the present invention of significantly improved birefringence. Thus, it is also preferred to employ a hot zone of a length greater than or equal to about 12 inches.

In one specific embodiment of the present invention, the hot zone employed is about twelve inches in length, the middle of the zone is positioned at or below the determined threadline freezepoint and the temperature in the hot zone is in the range of from about 250° to about 280° C.

In another specific embodiment of the present invention, the hot zone employed is about eighteen inches in length, the middle of the zone is positioned at or below the determined threadline freezepoint and the temperature in the hot zone is in the range of from about 200° to about 250° C.

In another specific embodiment of the present invention, the hot zone employed is about twenty-four inches in length, the middle of the zone is positioned above the determined threadline freezepoint and the temperature in the hot zone is in the range of from about 150° to about 225° C.

The structure of the heating zone can be any structure and/or enclosure which can attain the desired atmospheric temperature and is preferably a structure which is conducive to maintaining the desired temperature. Preferred is a tubular structure, preferably equipped with a resistance heater. The size of the tube is preferably such as to provide a one-quarter to one inch spacing from the filamentary material. The heating zone may also comprise simply a zone through which air or another gaseous medium of appropriate temperature is forced.

The resulting filamentary material is then withdrawn from the hot zone and contacted with a second gaseous quenching medium which is at a temperature below the glass transition temperature of the filamentary material. The contact is generally maintained until the filamentary material is no longer deformable and has solidified.

The second gaseous quenching medium can be the same or different from that of the first gaseous quenching medium with which the filamentary material is initially contacted. The temperature of the second gaseous quenching medium, however, must be at a temperature below the glass transition temperature of the filamentary material in order to insure that the filamentary material is solidified and achieves a non-deformable state. It is preferred that the second gaseous quench medium be provided at a temperature of from about 10° to about 55° C., and most preferably at about room temperature, e.g., at about 30° C. As in the case of the first gaseous quenching medium, the second gaseous quenching medium can be forced or unforced. As well, the chemical composition of the second gaseous quenching medium is not critical to the operation of the process provided it is not unduly reactive with the polymeric filamentary material, with air being the most preferred quenching medium. Other representative gaseous quench media which may be selected for utilization include inert gases such as helium, argon, nitrogen, etc.

The gaseous quenching medium preferably impinges upon the polymeric material so as to produce a uniform quench wherein no substantial radial in-homogeneity exists across the product. The uniformity of this quench may be demonstrated with a filamentary material through its ability to exhibit no substantial tendency to undergo self-crimping upon the application of heat.

Any suitable structure can be used for the quench zone provided it accommodates the contacting with the first quenching medium, the passage through the hot zone, and contacting with the second quenching medium. For example, a structure with essentially separate compartments for each contacting and the hot zone can be employed. It is generally preferred, however, for convenience, that a conventional quench zone, e.g., as defined by a cabinet, be employed with a hot tube being placed at the appropriate location in the quench zone, for example, as depicted generally in the FIGURE of the Drawing.

In the apparatus depicted in the FIGURE, polyester polymer, e.g., polyethylene terephthalate, can be placed in hopper 1 and advanced toward spinneret 2 by the aid of a screw conveyor 4. Heaters 6 cause the polyethylene terephthalate polymer to melt to form a homogeneous phase which is then further advanced toward spinneret 2 by the aid of pump 8.

The spinneret 2 can be any standard spinneret, for example, it can have a conical entrance and possess a ring of 20 extrusion holes, each having a diameter of about 10 mils. The molten polyester can be heated to a temperature of from 250° to 310° C. for extrusion through spinneret 2.

Upon extrusion, the resulting extruded polyester filamentary material 9 is passed directly from spinneret 2 into quench zone 20, which in the FIGURE is defined by a quench cabinet. Commonly, the entire quench zone will possess a length of from about 2.5 to 20 feet, and preferably from about 3 to about 7 feet. If a forced atmosphere is employed, the gaseous atmosphere is typically blown perpendicularly across the filamentary material 9 through a distribution or quench screen 24 and allowed to vent freely.

In the FIGURE, a suitable gaseous medium 12 such as air, e.g., at about room temperature, is continuously introduced into the quench zone 20 at 14, which thereby proceeds to act as the first gaseous quenching medium 23 and the second gaseous quenching medium 25. The gaseous medium 12 is supplied via conduit 16 and fan 18. The air is then simply allowed to vent freely at 27. If desired, the quench zone atmosphere can comprise simply unforced air, with the ambient air acting as the quenching media 23 and 25.

In passing through the quench zone, the filamentary material 9 contacts quenching media 23 and 25 and passes through a hot zone, represented generally by 10, in between the contacting of the quenching media.

Initially, the filamentary material contacts the gaseous quenching medium 23, i.e., the first gaseous quenching medium, above the hot zone 10. The filamentary material then passes through the hot zone. The hot zone is preferably positioned in the quench zone so that its middle is near the threadline freezepoint of the filamentary material as would be determined in the absence of the hot zone 10. In any event, it is important that the hot zone be positioned so that the filamentary material 9 is still in a deformable state upon entering the hot zone 10. In a preferred embodiment, the hot zone 10 comprises a tubular structure as discussed previously.

The hot zone 10 can be of any suitable length, but is preferably of a length from 12 inches to about 24 inches. In the FIGURE, an air atmosphere is maintained in the hot zone of a temperature ranging from about 150° to about 300° C. by the aid of any suitable means, e.g., a resistance heater (not shown). The filamentary material is generally present in the hot zone 10 for a residence time of from 0.003 to about 0.100 second.

Upon passing through the hot zone, the filamentary material 9 is then contacted with the second gaseous medium 25, which in the depicted instance is the same gaseous medium as quenching medium 23. The contact with quenching medium 25 is generally of sufficient duration as to result in the filamentary material becoming solidified and essentially non-deformable.

Upon completion of the quench to a non-deformable state, the filamentary material is withdrawn from the quench zone 20 at the rate of the wind-up speed. If desired, the filamentary material can be passed through a finish applicator 3 upon being withdrawn from the quench zone. The filamentary material is then passed onto bobbin 30, and optionally, initially through godets 32 and 34. The present invention has been found to be quite appropriate for melt-spinning processes employing wind-up speeds of from 1000 to about 6000 meters per minute, and more particularly for the range of from about 2500 to 4000 meters per minute. The yarns thereby obtained can be subsequently drawn and/or textured in a manner conventional with treatment of partially oriented yarn.

The process of the present invention provides one with a method for expeditously, with a given wind-up speed, obtaining partially oriented yarn of increased birefringence, and hence, higher orientation. Birefringence, as is known to those skilled in the art, is a function of the orientation of a filamentary fiber and is expressed as the difference in the refractive index of a filamentary fiber parallel to and perpendicular to its axis. Accordingly, one can achieve via the present invention a POY product exhibiting high wind-up speed properties, particularly orientation, at lower wind-up speeds. The present invention would, therefore, find particular significance in dealing with winders of limited speed. For example, when certain levels of orientation in POY yarns are desired which generally can only be achieved through the use of new high speed winders, such levels of orientation could be achieved through the use of older equipment via the utilization of the present invention. The economic advantages associated with the present invention are therefore significant.

The yarn produced by the present process should not, however, be confused with the yarn produced by processes such as that disclosed in U.S. Pat. No. 3,946,100. There is a major difference in the yarn products obtained. As discussed, the products obtained by the present invention are POY as they exhibit POY like properties, including birefringence. Such yarns would thus be subsequently drawn and/or textured as is conventional with POY products. The process of U.S. Pat. No. 3,946,100, however, even at relatively low wind-up speeds of about 2500 meters per minute, generally produces a product exhibiting drawn yarn like properties, e.g., as characterized by birefringence, shrinkage and elongation.

The following example is given as a specific illustration of the claimed invention. It should be understood, however, that the specific details set forth in the examples are merely illustrative and is nowise limitative.

EXAMPLE

A number of runs were made in accordance with the present invention under varying conditions of wind-up speed, hot zone position and hot zone temperature. All other conditions were equal.

In general, polyethylene terephthalate having an intrinsic viscosity (I.V.) of about 0.67 was extruded through a 10 hole spinneret, each hole having a diameter of 10 mil. The extruded filamentary material was quenched with a crossflow of air of about 30° C. forced at about 90 ft./min., passed through a hot zone, which was a heated tube, quenched to a non-deformable state, and then withdrawn from the quench zone and wound. The placement of the hot zone tube, its length and temperature, the wind-up speed employed, and the properties of the resulting yarn products are listed in the Table below. Unless otherwise indicated, the properties were determined in accordance with the procedures of U.S. Pat. No. 3,946,100, which is hereby incorporated by reference. The position of the threadline freezepoint, as indicated in the Table, was determined by a laser doppler anemometer in the absence of the hot zone. Also included in the Table are two comparative runs made without the use of a hot zone.

For comparative purposes, the Table also includes the two examples of U.S. Pat. No. 3,946,100 illustrating the use of a thermal conditioning zone subsequent to the quench zone.

hibits drawn yarn like properties, i.e., birefringence of about 0.120, shrinkage of about 4 percent and elongation of about 50 percent. These are much different than the POY like properties which result from the process of the present invention.

Although the invention has been described with preferred embodiments, it is to be understood that variations and modifications may be resorted to as will be apparent to those skilled in the art. Such variations and modifications are to be considered within the purview and scope of the claims appended hereto.

What is claimed is:

1. A process for melt spinning a partially oriented yarn of increased birefringence for a given wind-up speed comprising extruding a molten fiber forming polyester through a shaped orifice to form a molten filamentary material, passing said molten filamentary material in the direction of its length into a quench zone, wherein the filamentary material is initially contacted with a first gaseous quenching medium at a temperature well below the melting temperature of the filamentary material, and wherein prior to solidification so that the filamentary material is still in a deformable state, the filamentary material is passed through a hot zone provided with an atmosphere having a temperature greater than the temperature of the first gaseous quenching medium and greater than the glass transition temperature of the polyester filamentary material, with the resulting filamentary material then being withdrawn from said hot zone and contacted with a second gaseous quenching medium at a temperature below the glass transition temperature until the filamentary material is no longer deformable, and then withdrawing the filamentary material from the quench zone;

with the said processing of the polyester filamentary material following the extrusion being conducted at a substantially constant take-up speed.

TABLE

| Example | WUS (mpm) | DPF* | FREEZE POINT (cm)** | TUBE LENGTH (in.) | TUBE CENTER POSITION (cm)** (IN QUENCH ZONE) | TUBE TEMP. (°C.) | DENSITY ($gcm^{-3}$) |
|---|---|---|---|---|---|---|---|
| 1 Comparative (No hot tube) | 2650 | 6 | 90 | — | — | — | 1.3408 |
| 2 Invention | 2650 | 6 | — | 12" | 90 (At) | 280 | 1.3436 |
| 3 Invention | 2650 | 6 | — | 18" | 113 (Below) | 200 | 1.3437 |
| 4 Comparative (No hot tube) | 4000 | 6 | 120 | — | — | — | 1.3472 |
| 5 Invention | 4000 | 6 | — | 18" | 120 (At) | 250 | 1.3540 |
| 6 Invention | 4000 | 6 | — | 24" | 90 (Above) | 200 | 1.3553 |
| U.S. Pat. No. 3,946,100 | | | | | | | |
| 7 Comparative | 2500 | 2 | — | — | After Quench Zone | 120 | — |
| 8 Comparative | 3000 | 2 | — | — | After Quench Zone | 120 | — |

*DPF = denier per filament
**cm = distance from spinneret

| EXAMPLE | BIREFRINGENCE | SHRINKAGE (%) | TENACITY (g/d) | MODULUS (g/d) | ELONGATION % |
|---|---|---|---|---|---|
| 1 Comparative (No hot tube) | .033 | 60*** | 2.48 | 30.0 | 162 |
| 2 Invention | .046 | 55*** | 3.01 | 31.4 | 134 |
| 3 Invention | .048 | 59*** | 2.75 | 38.2 | 129 |
| 4 Comparative (No hot tube) | .062 | 50*** | 3.2 | 41.0 | 110 |
| 5 Invention | .087 | 38*** | 3.3 | 56.0 | 79 |
| 6 Invention | .086 | 12*** | 4.0 | 70.0 | 82 |
| U.S. Pat. No. 3,946,100 | | | | | |
| 7 Comparative | .119 | 3.6**** | 3.7 | 70.0 | 56 |
| 8 Comparative | .124 | 3.8**** | 4.0 | 76 | 50 |

***Determined by immersion in boiling water at 100° C. for five minutes.
****Determined by DuPont Thermochemical Analyzer Model 941 as specified in U.S. Pat. No. 3,946,100.

As can be seen from the Table upon a comparison of conventional runs 1 and 4 with the invention runs 2, 3 and 5, 6 respectively, the structural properties of birefringence (orientation) and density (crystallinity) are significantly higher for the hot tube (invention) spun POY yarns than for the conventionally spun POY yarns. These structural effects are also clearly reflected in the mechanical properties, i.e., higher modulus and tenacity and lower elongation.

As can be seen from the comparative examples of U.S. Pat. No. 3,946,100, even at relatively low wind-up speeds of about 2500 mpm, yarn produced thereby ex- 2. The process of claim 1 wherein the first gaseous quenching medium is of a temperature below the glass transition temperature of the filamentary material.

3. The process of claim 2 wherein the fiber-forming polyester is substantially all polyethylene terephthalate.

4. The process of claim 2 wherein the fiber-forming polyester contains 85 to 100 mole percent polyethylene terephthalate and 0 to 15 mole percent of copolymerized ester units other than polyethylene terephthalate.

5. The process of claim 2 wherein the fiber-forming polyester is at a temperature of about 250° to 310° C. when extruded through the orifice and wherein the temperature of the resultant polyester filamentary material is reduced from about 120 to 150 degrees in temperature prior to being passed through the hot zone.

6. The process of claim 2 wherein the hot zone is no greater than 2 feet in length.

7. The process of claim 6 wherein the hot zone is about 18 inches in length.

8. The process of claim 2 or 7 wherein the filamentary material is withdrawn from the quench zone at a rate of about 1000 to 6000 meters per minute.

9. The process of claim 8 wherein the rate is in the range of from about 2500 to 4000 meters per minute.

10. The process of claim 2 wherein the temperature of the atmosphere in the hot zone is in the range of from about 150° to 300° C.

11. The process of claim 9 wherein the temperature is in the range of from about 200° to 280° C.

12. The process of claim 2 wherein the hot zone is positioned near the threadline freezepoint of the filamentary material as determined in the absence of the hot zone.

13. The process of claim 12 wherein the middle of the hot zone is positioned at or below the threadline freezepoint and the top of the hot zone is positioned at or above the threadline freezepoint.

14. The process of claim 2 wherein the hot zone comprises a tube of an internal diameter sufficient to provide a one-quarter to one inch spacing from the filamentary material.

15. The process of claim 2 wherein the gaseous quenching medium is of a temperature in the range of from about 10° to about 55° C.

16. A process for melt spinning a partially oriented yarn of increased birefringence for a predetermined wind-up speed comprising:

extruding a molten fiber-forming polyester through a spinneret to form a molten filamentary material, passing said molten filamentary material in the direction of its length into a quench zone wherein the filamentary material is initially contacted with a gaseous quenching medium at a temperature below the glass transition temperature of said molten filamentary material, and wherein prior to solidification so that the filamentary material is still in a deformable state, the filamentary material is passed through a hot zone of a length not greater than about 2 feet, which is provided with an atmosphere having a temperature in the range of from about 150° to about 300° C., and with the hot zone being positioned near a threadline freezepoint of the filamentary material as determined in the absence of a hot zone, and with the resulting filamentary material then being withdrawn from the hot zone and again contacted with a gaseous quenching medium at a temperature below the glass transition temperature of the material until the filamentary material is no longer in a deformable state, and then withdrawing the filamentary material from the quench zone at a rate of from about 1000 to about 6000 meters per minute;

with the processing of the polyester filamentary material following the extrusion being conducted at a substantially constant take-up speed.

17. The process of claim 16 wherein the fiber-forming polyester is substantially all polyethylene terephthalate.

18. The process of claim 16 wherein the rate of withdrawal from the quench zone is from about 2500 to 4000 meters per minute.

19. The process of claim 16 wherein the temperature in the hot zone is in the range of from about 200° to about 280° C.

20. The process of claim 16 wherein the gaseous quenching medium is of a temperature in the range of from about 10° to about 55° C.

21. The process of claim 16 wherein the hot zone is about twelve inches in length, the middle of the zone is positioned at or below the determined threadline freezepoint and the temperature in the hot zone is in the range of from about 250° to about 280° C.

22. The process of claim 16 wherein the hot zone is about eighteen inches in length, the middle of the zone being positioned at or below the determined threadline freezepoint and the temperature in the hot zone being in the range of from about 200° to about 250° C.

23. The process of claim 16 wherein the hot zone is about twenty-four inches in length, the middle of the zone being positioned above the determined threadline freezepoint and the temperature in the hot zone being in the range of from about 150° to about 225° C.

* * * * *